United States Patent [19]

Stewart

[11] Patent Number: 4,998,703

[45] **Date of Patent: * Mar. 12, 1991**

[54] PORTABLE ILLUMINATED BOOKHOLDER AND LECTERN

[76] Inventor: Richard M. Stewart, 236 Central Rd., Middlebury, Conn. 06762

[ * ] Notice: The portion of the term of this patent subsequent to Jan. 23, 2007 has been disclaimed.

[21] Appl. No.: 512,490

[22] Filed: Apr. 23, 1990

[51] Int. Cl.[5] ..... A47B 97/04

[52] U.S. Cl. ..... 248/447; 248/461; 248/446

[58] Field of Search ..... 248/446, 447, 454, 458, 248/460, 461

[56] References Cited

U.S. PATENT DOCUMENTS

| | | | |
|---|---|---|---|
| 898,692 | 9/1908 | Shepard | 248/446 |
| 1,051,047 | 1/1913 | Wood . | |
| 1,079,033 | 11/1913 | Steinhoff | 248/454 |
| 1,666,803 | 4/1928 | Walker | 248/454 |
| 2,489,553 | 11/1949 | Wofford | 224/46 |
| 2,732,481 | 1/1956 | King | 248/477 X |
| 3,424,283 | 1/1969 | Sheldon | 248/461 |
| 4,093,326 | 6/1978 | Ford | 312/231 |
| 4,323,214 | 4/1982 | DeLuca | 248/452 |
| 4,421,933 | 9/1984 | Nelson | 248/461 |
| 4,896,252 | 1/1990 | Stewart | 363/98 |

*Primary Examiner*—Gary L. Smith
*Assistant Examiner*—Michael J. Milano
*Attorney, Agent, or Firm*—William C. Crutcher

[57] ABSTRACT

An improved bookholder comprises a lower part, which has a base member and upstanding, spaced, front and rear walls, and an upper part, which has a top member and spaced depending left and right side walls. The upper part is adapted to provide a complementary fit with the lower part so as to form a box-like structure. One or more hinges connect the top member with the rear wall, and a retaining strip clamped between the top member and rear wall lock the upper part in position.

The side walls are pivotally attached near their centers to the top member by thumb screw tightened pivot pins for orientation into parallel spaced relationship, a mutually perpendicular position and a mutually co-planar position for temporarily re-orientating and fixing said side walls on said top member to provide ledges for holding a book.

10 Claims, 3 Drawing Sheets

PORTABLE ILLUMINATED BOOKHOLDER AND LECTERN

BACKGROUND OF THE INVENTION

This invention relates generally to an improved illuminated bookholder and lectern which is portable and compact when it is not in use. More particularly, the invention relates to improvements in reducing the size and cost and in increasing the versatility of a portable illuminated bookholder.

In my U.S. Pat. No. 4,907,777 issued Mar. 13, 1990, an improved bookholder was disclosed for inclined reading in bed, wherein a support arm assembly comprising arms disposed at right angles to one another and providing ledges for holding a book was pivotally attached to a back wall. The back wall was supported from a base to form the lid for an open box structure with an illuminating device inside.

Further improvements to this type of bookholder led to my U.S. Pat. No. 4,896,252 issued Jan. 23, 1990, wherein a pair of separately movable arms were pivotably attached to the lid, so as to provide ledges for supporting a book for reclined reading or alternatively supporting a book in horizontal position in the manner of a lectern. The arms were individually hinged so that they would fold and nest inside the box when folded. Although the pivotable, foldable arms are quite satisfactory for some models of my bookholder, the desire to further reduce the cost and simplify the structure has led to further improvements.

In a portable bookholder, its weight is important and it is desirable that there be no unnecessary structural members to add to the weight. The bookholder should be designed so that it will fold into the smallest possible package having a pleasing appearance, yet provide maximum versatility and ease of deployment to perform its intended function.

Accordingly, one object of the present invention is to provide an improved portable bookholder with a reduced number of parts and improved appearance.

Another object of the invention is to provide an improved portable bookholder and lectern suitable for holding and illuminating a book or the like in either inclined or horizontal positions.

SUMMARY OF THE INVENTION

Briefly stated, an improved bookholder comprises a lower part, which has a base member and upstanding spaced front and rear walls attached thereto, and an upper part, which has a top member and spaced depending left and right side walls attached thereto said upper part being adapted to provide a complementary fit with said lower part whereby said members and said walls together define a box-like structure.

There are first means for temporarily orienting and fixing the sidewalls in parallel relationship, second means for temporarily orienting and fixing said upper part with respect to said lower part with said top member extending substantially vertically, said first means being adapted for temporarily re-orienting and fixing said side walls on said top member to provide ledges for holding a book.

In the preferred embodiment, the first means pivotably attach the side walls near their centers to the top member by thumb screw tightened pivot pins for orientation into parallel spaced relationship, a mutually perpendicular position, and a mutually co-planar position.

The second means in the preferred form includes one or more hinges connecting the top member with the rear wall, and a retaining strip clamped between the top member and rear wall to lock the upper part in position.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

FIG. 1 is a perspective view of my improved bookholder in a closed position for transporting, FIG. 2 is a side elevation drawing, in section, taken along lines II—II of FIG. 1, FIG. 3 is a perspective view similar to FIG. 1, with the upper part of the bookholder oriented and fixed in an open position, FIG. 4 is a partial side elevation drawing, partly in section of the open bookholder of FIG. 3, taken along lines IV—IV, FIG. 5 is a partial rear elevation drawing of the open bookholder taken along lines V—V of FIG. 4, FIG. 6 is a perspective view of the bookholder fully deployed to hold a book for inclined reading, and FIG. 7 is a similar perspective view of the bookholder fully deployed to serve as a horizontal holder or a lectern.

DESCRIPTION OF THE PREFERRED EMBODIMENT

Figure 1:
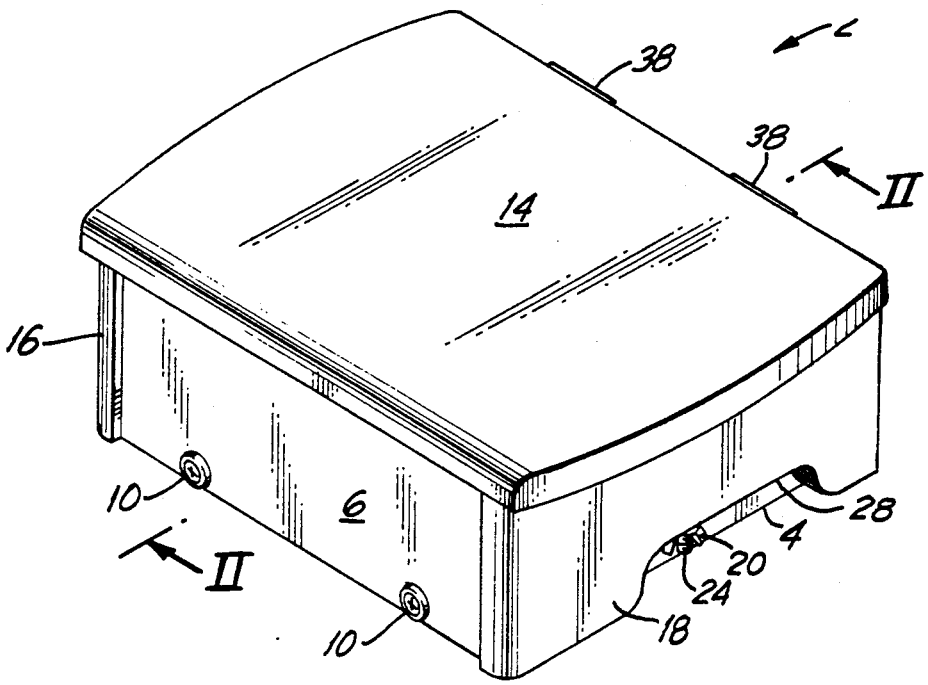

Referring now to FIG. 1 of the drawing, a bookholder is shown generally at 2, in a closed position to comprise a box-like structure. Bookholder 2 includes a lower part having a base member 4, a front wall 6 and a spaced rear wall 8. Base member 4 is substantially rectangular and front wall 6 is attached perpendicular thereto by screws 10 along the front edge, while rear wall 8 is attached by screws 12 along the rear edge of the base member, so that both walls are upstanding from the base member.

Figure 2:
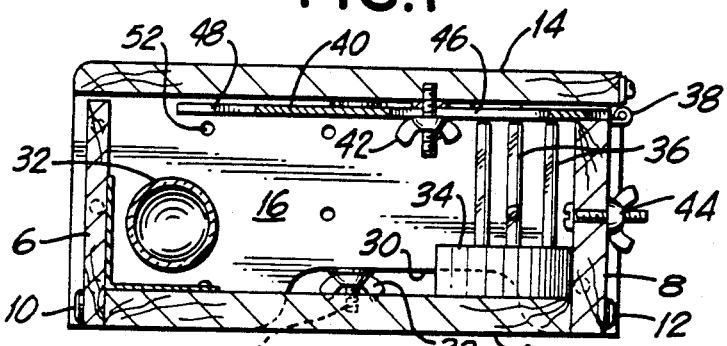

The bookholder 2 further includes an upper part having a top member 14, and spaced left and right side walls 16, 18 attached thereto. The side walls 16, 18 depend from the top member 14 and are connected thereto by first means for temporarily orienting and fixing the side walls in various selected positions on the top member 14. Preferably such first means are provided by thumb screws 20, 22 and threaded studs 24, 26 projecting from the top member and extending through the side walls near the centers of their lengths. Such studs may be attached to the top as illustrated in my aforementioned U.S. Pat. No. 4,896,252, so as to allow pivoting of the side walls 16, 18 into various selected positions where they are fixed by tightening the thumb screws 20, 22. One of such selected positions is shown in FIG. 1, wherein the walls 16, 18 are spaced from one another in parallel relationship. The spacing between walls 16, 18 is greater than the lengths of the front wall 6 and rear wall 8. The left and right side walls include cutouts, 28, 30 for picking up the bookholder and for access to the thumb screws. As best seen in FIGS. 1 and 2, the upper part is adapted to provide a complementary fit with the lower part to define a box-like structure.

Inside the box-like structure is disposed an illuminating lamp 32 and a receptacle 34 for a quantity of page holding pegs 36. The upper part of the bookholder preferably is attached to the lower part for pivotable movement by means of hinges 38, although it is within the scope of the invention to employ detachable upper and lower parts.

Figure 4:
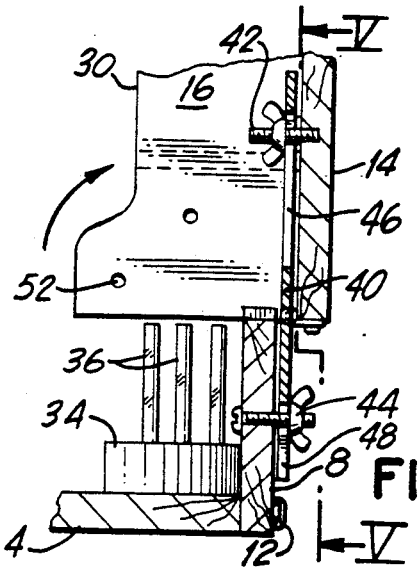
Figure 5:
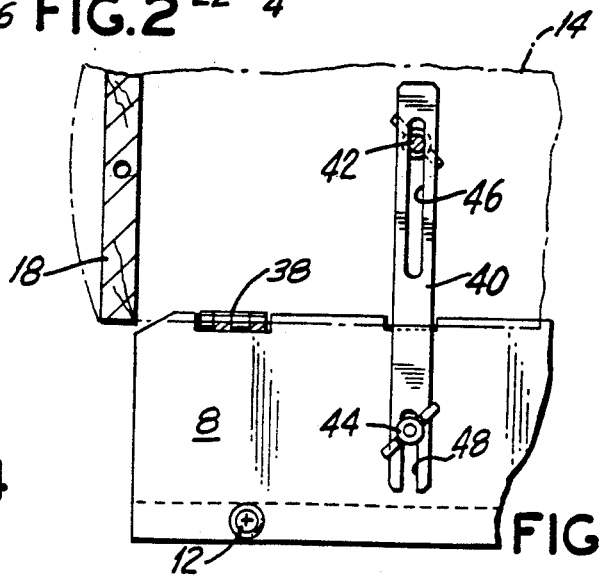
Figure 3:
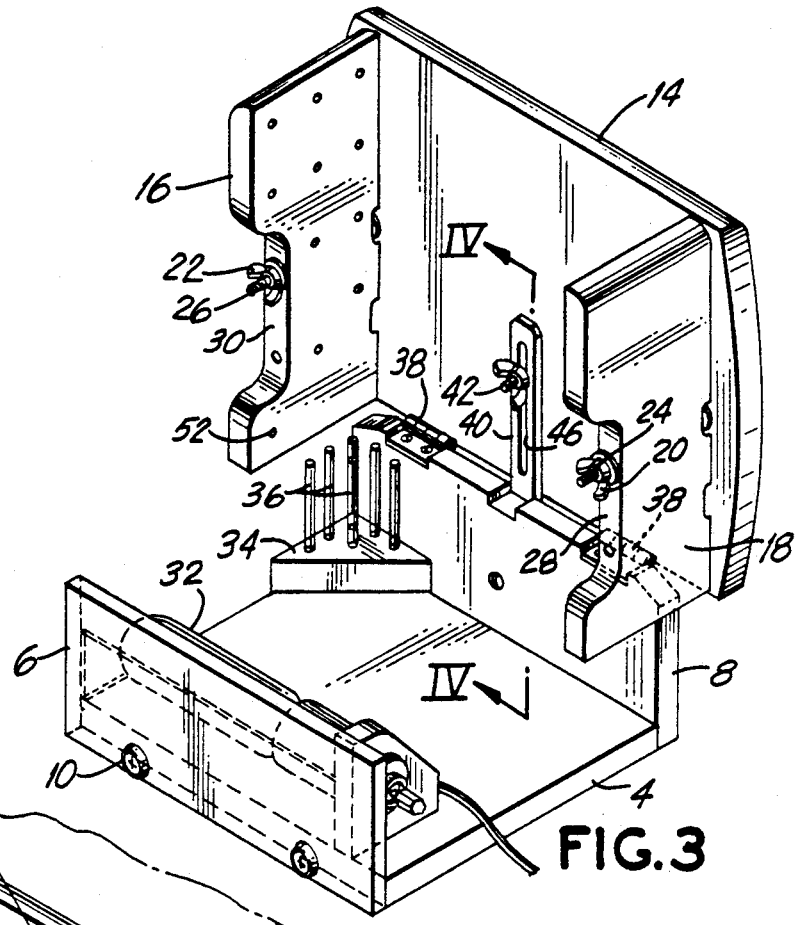

Referring now to FIGS. 3, 4 and 5 of the drawings, the same reference numerals indicate the same elements as discussed in connection with FIGS. 1 and 2. However in FIGS. 3, 4 and 5, the upper part of the bookholder comprising top member 14 and side walls 16, 18 with associated members has been oriented to an open position with the top member 14 in a substantially vertical position. The upper part is supported on the lower part which comprises the base member 4 and the front and rear upstanding walls 6, 8 respectively. Means are provided for temporarily orienting and fixing the upper part in this position. Various types of suitable means are available, but the simple arrangement shown in the preferred embodiment comprises a slotted retaining strip 40 with means to clamp it to the top member 14, such as thumb screw 42, and means to clamp it to the rear wall 8, such as thumb screw 44. As best seen in FIG. 5, the retaining strip 40 has a closed slot 46 for allowing the strip to slide along thumb screw 42 without becoming detached, and an open slot 48 cooperating with thumb screw 44. When the thumb screws 42, 44 are both tightened, the top member 14 is held rigidly parallel to rear wall 8 in a vertical position. When the thumb screws are loosened, retaining strip 40 may be slid clear of screw 44, and then clamped to the top member 14 for storage, as best seen in FIG. 2.

In accordance with the present invention, the side walls 16, 18 not only serve as enclosure members to define part of the box-like structure, but, also serve as ledges for supporting a book or the like when the bookholder is fully deployed. The side walls may be re-oriented and fixed, as shown in alternate arrangements of FIG. 6 and FIG. 7.

Figure 6:
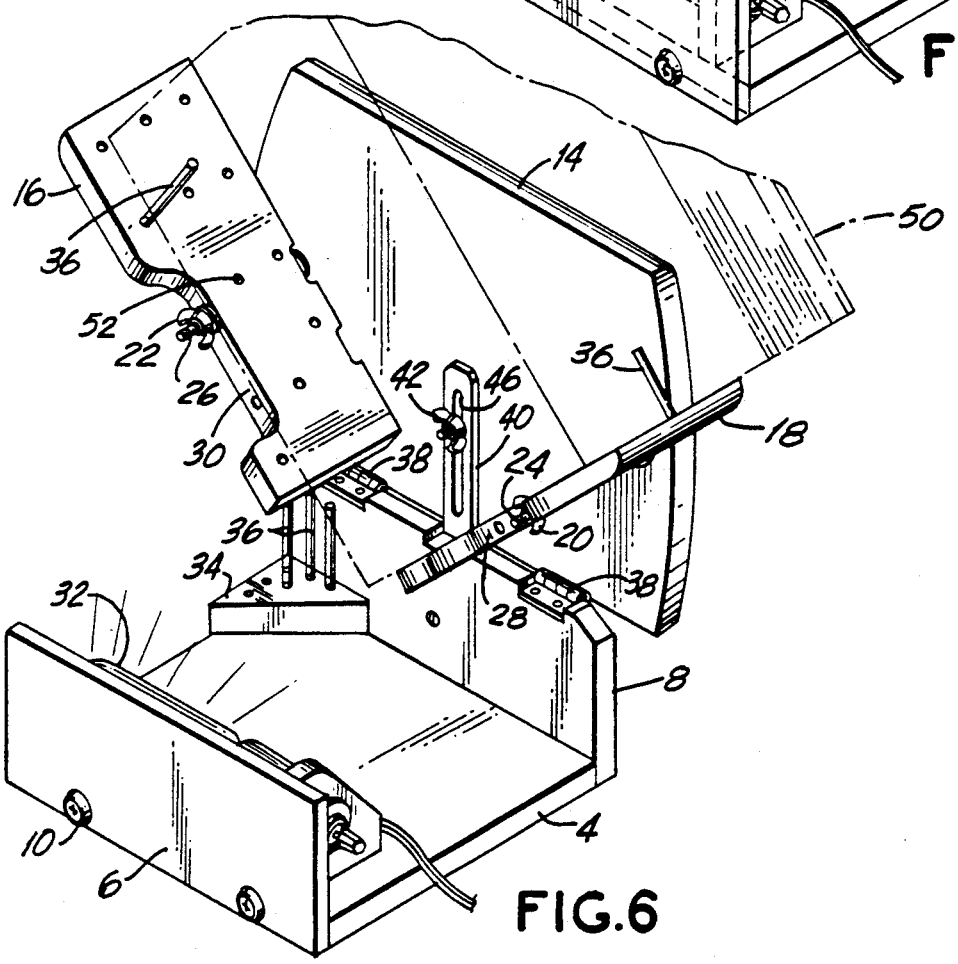

Referring to FIG. 6, the left and right side walls 16, 18 are re-oriented and fixed in mutually perpendicular positions on the top member 14 by loosening thumb screws 20, 22 and pivoting to the position shown, where the side walls 16, 18 are mutually perpendicular to one another. Side walls 16, 18 are also substantially perpendicular to the top member 14, so that they act as ledges for support of a book 50. The book 50 is thus supported at a 45° angle for inclined reading as disclosed in my aforementioned patents. However, rather than needing separate shelves dedicated to support a book, the side walls themselves perform a dual function and also serve as shelves or ledges to support the book in the improved bookholder. In order to hold the pages of the book, the inner surfaces of side walls 16, 18 are supplied with suitable peg holes 52, in which the page holder pegs 36 may be inserted to hold the pages in a manner known in the art. The pageholder pegs 36 are obtained from the holder 34. Book 50 may be illuminated while reading by the lamp 32 in a manner known in the art, with front wall 6 shielding it from the eyes of the reader. The inside of front wall 6 may be provided with a layer of reflective material to increase the illumination.

Figure 7:
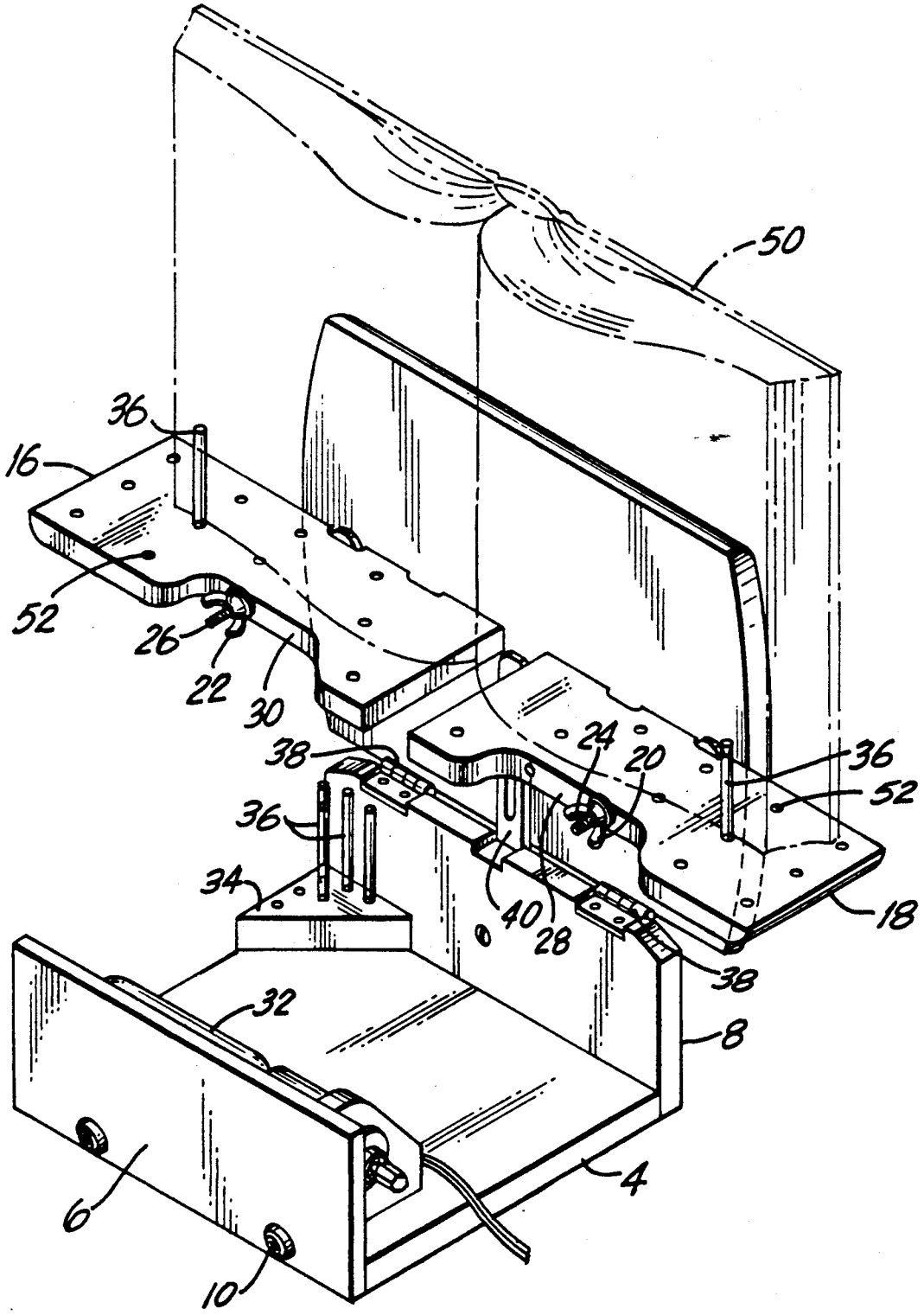

FIG. 7 shows the same reference numbers as previously mentioned. However in this case, the bookholder is deployed for holding book 50 in a vertical position, either for reading or for using the bookholder as a lectern. To accomplish this, the thumb screws 20, 22 are loosened and the side walls 16, 18 pivoted until they lie in a common plane which is substantially horizontal. In this position the side walls are mutually co-planar. When oriented in this position the side walls serve as ledges to support the book and pegs 36 hold the pages as previously described.

When one desires to fold the bookholder into a portable transportable structure, it is only necessary to loosen thumb screws 20, 22 to pivot the side walls to a substantially parallel spaced relationship and retighten the thumb screws, to loosen thumb screws 42, 44 on the retaining strip 40, clamping it to the top member 14, and then pivoting the upper part into complementary engagement with the lower part to form a box-like structure. The illuminating lamp 32 and the page holding pegs 36 are enclosed, for use when the bookholder is reopened.

By combining the book-supporting arms and the side walls into the same structure, an improved construction with fewer parts and lower cost results. Also the size of the bookholder may be substantially reduced without sacrifice in operability.

While there has been described what is considered to be the preferred embodiment of the invention, other modifications will occur to those skilled in the art, and it is desired to secure in the appended claims all such modifications as fall within the true spirit and scope of the invention.

I claim:

1. An improved bookholder, comprising:

a lower part having a base member and having spaced upstanding front and rear walls attached thereto, an upper part having a top member and having spaced depending left and right side walls attached thereto, said depending left and right side walls of said upper part being so spaced and dimensioned as to provide a complementary fit with said upstanding front and rear walls of said lower part, thereby defining a box-like structure, first means for temporarily orienting and fixing said side walls in spaced parallel relationship on said top member, said first means being adapted to re-orient and fix said side walls to support a book thereon, second means for orienting and fixing said upper part to be supported from said lower part with said top member extending substantially vertically, so as to support a book on said re-oriented side walls.

2. The improvement according to claim 1, said second means including hinges pivotably connecting the top member of said upper part to the rear wall of said lower part, said second means further comprising a clamp cooperatively associated with the rear wall and top member.

3. The combination according to claim 1, wherein said first means comprises first and second pivot pins extending through the respective left and right side walls, together with tightening means for fixing said side walls in selected pivoted positions.

4. The improvement according to claim 1, wherein said first means are arranged to re-orient and fix said side walls in mutually perpendicular positions on said top member.

5. The improvement according to claim 1, wherein said first means are arranged to re-orient and fix said side walls in a mutually co-planar relationship on said top member.

6. The improvement according to claim 1, wherein an illuminating lamp is disposed adjacent said front wall and adapted to be enclosed within said box-like structure.

7. The improvement according to claim 1, and further including a plurality of pageholding pegs and a holder therefor disposed within said box-like structure.

8. The bookholder according to claim 1, wherein the spacing between said side walls is greater than the lengths of said front and rear walls.

9. An improved bookholder comprising:

a lower part having a substantially rectangular base member and having spaced upstanding front and rear walls attached thereto on opposite sides thereof, an upper part having a planar top member and having spaced depending left and right side walls pivotally attached thereto on opposite sides thereof, hinge means providing a pivotal attachment between said top member and said rear wall, said depending left and right side walls of said upper part being so spaced and dimensioned as to provide a complementary fit with said upstanding front and rear walls of said lower part thereby defining a box-like structure when pivoted to a closed position, a retaining strip arranged to be clamped to said top member and to said rear wall so as to fix the upper part with the top member extending substantially vertically, and first means for temporarily orienting and fixing said side walls in parallel relationship, said first means being arranged for pivoting the side walls to re-orient and fix said side walls in a mutually perpendicular position to provide an inclined reading bookholder, and to re-orient and fix said side walls in a co-planar position to provide a lectern, whereby said side walls serve to support a book in at least two reading positions.

10. The bookholder according to claim 9, wherein the spacing between said side walls is greater than the lengths of said front and rear walls, and wherein the lengths of said side walls is greater than the spacing between said front and rear walls.

* * * * *